US007191786B2

(12) United States Patent
Awad

(10) Patent No.: US 7,191,786 B2
(45) Date of Patent: Mar. 20, 2007

(54) APPARATUS AND METHOD FOR FLUSHING AND CLEANING ENGINE LUBRICATION SYSTEMS

(76) Inventor: Adam A. Awad, 160 Fairhaven La., Costa Mesa, CA (US) 92626

( * ) Notice: Subject to any disclaimer, the term of this patent is extended or adjusted under 35 U.S.C. 154(b) by 0 days.

(21) Appl. No.: 10/266,529

(22) Filed: Oct. 8, 2002

(65) Prior Publication Data

US 2004/0065347 A1 Apr. 8, 2004

(51) Int. Cl.
*B08B 3/04* (2006.01)

(52) U.S. Cl. ..... 134/169 A; 134/166 R; 123/196 A; 184/6

(58) Field of Classification Search ..... 134/166 R, 134/169 A, 16 A; 123/196 A, 196 R, 198 R; 184/6, 1.5; 141/65, 92
See application file for complete search history.

(56) References Cited

U.S. PATENT DOCUMENTS 5,467,746 A * 11/1995 Waelput et al. ..... 123/196 A
5,482,062 A 1/1996 Chen
5,566,781 A 10/1996 Robert et al.
5,573,045 A 11/1996 Akazawa
5,791,310 A 8/1998 Grigorian
5,813,382 A 9/1998 Grigorian
5,833,765 A 11/1998 Flynn
5,921,213 A 7/1999 Grigorian
6,041,798 A 3/2000 Grigorian
6,089,205 A 7/2000 Grigorian
6,142,161 A 11/2000 Abbruzze
6,263,889 B1 7/2001 Flynn
6,298,947 B1 10/2001 Flynn
6,318,388 B1 11/2001 Edmiston et al.
6,604,557 B2 * 8/2003 Awad ..... 141/65

* cited by examiner

*Primary Examiner*—M. Kornakov
(74) *Attorney, Agent, or Firm*—Gene Scott - Patent Law & Venture Group

(57) ABSTRACT

A method and apparatus for connecting an engine flushing system for flushing the lubrication system of an engine having a detachable engine lubricant filter contained within a casing is disclosed, which may comprise at least one flushing system connection unit adapted to connect the flushing system to at least one of the engine lubricant inlet portion and engine lubricant outlet portion of the detachable lubricant filter through the casing of the detachable engine lubricant filter. The flushing connection unit may comprise a first flushing connection unit adapted to connect the flushing system to the engine lubricant inlet portion and engine lubricant outlet portion of the detachable lubricant filter, through the casing of the detachable engine lubricant filter; and a second flushing connection unit adapted to connect the flushing system to the lubrication system of the engine through an opening utilized for mechanically measuring the level of lubricant in the lubrication system of the engine.

26 Claims, 7 Drawing Sheets

APPARATUS AND METHOD FOR FLUSHING AND CLEANING ENGINE LUBRICATION SYSTEMS

RELATED APPLICATIONS

Applicant has filed a related application, Ser. No. 10/006,345, filed on Dec. 3, 2001, entitled Automotive Radiator Flush System and Methods of Use, the disclosure of which is hereby incorporated by reference.

FIELD OF THE INVENTION

This application relates to the field of apparatus and methods for flushing and cleaning lubricant systems in engines, e.g., internal combustion engineers.

BACKGROUND OF THE INVENTION

It is well known in the art to flush engine coolant systems, with U.S. Pat. No. 5,573,045, entitled ENGINE COOLANT CHANGING APPARATUS, issued to Akazawa an Nov. 12, 1996 ("Akazawa"), the disclosure of which is hereby incorporated by reference. It is also watt known in the art to flush old oil and carbonaceous deposits and sludge and the like from inside of the engine causing, using flushing equipment similar to that disclosed in the applicant's co-pending application and in the Akazawa, United States patents such as those assigned to EnviroLution, Inc., i.e., U.S. Pat. No. 6,142,161, entitled CLOG RESISTANT PAN ADAPTER, issued to Abbruzze on Nov. 7, 2000 ("Abbruzze"); U.S. Pat. No. 6,089,205, entitled ADAPTER SYSTEM FOR ENGINE FLUSHING APPARATUS, issued to Grigorian, et al. on Jul. 18, 2000 ("Grigorian V"); U.S. Pat. No. 6,041,798, entitled OIL PAN DRAIN PORT ADAPTER SYSTEM FOR ENGINE FLUSHING APPARATUS, issued to Grigorian, et al. on Mar. 28, 2000 (Grigorian IV); U.S. Pat. No. 5,921,213, entitled ADAPTER SYSTEM FOR ENGINE FLUSHING APPARATUS, issued to Grigorian, et al. on Jul. 13, 1999 ("Grigorian III"); U.S. Pat. No. 5,813,382, entitled OIL PAN DRAIN PORT ADAPTER SYSSTEM FOR ENGINE FLUSHING APPARATUS, issued to Grigorian, et al. on Sep. 29, 1998 (Grigorian II"); and U.S. Pat. No. 5,791,310, entitled ADAPTER SYSTEM FOR ENGINE FLUSHING APPARATUS, issued to Grigorian, et al. on Aug. 11, 1998 ("Grigorian I"), and issued to Robert Flynn, i.e., U.S. Pat. No. 6,298,947, entitled ENGINE OIL CLEANING SYSTEM, issued to Flynn on Oct. 9, 2001 ("(Flynn III"), U.S. Pat. No. 6,263,889, entitled ENGINE LUBRICATION CLEANING SYSTEM, issued to Flynn, et al. on Jul. 24, 2001 ("Flynn II") and U.S. Pat. No. 5,833,765, entitled ENGINE CONDITIONING APPARATUS AND METHOD, issued to Flynn, et al. on Nov. 10, 1998 ("Flynn I"), and other patents. e.g., U.S. Pat. No. 6,318,388, entitled ENGINE FLUSHING APPARATUS, issued to Edmiston, et al. on Nov. 20, 2001; U.S. Pat. No. 5,566,781, entitled APPARATUS AND METHODS FOR FLUSHING AND CLEANING OIL STRAINER, CRANKCASE AND OTHER COMPONENTS OF AN INTERNAL COMBUSTION ENGINE, issued to Robert, et al. on Oct. 22, 1996 and U.S. Pat. No. 5,482,062, entitled APPARATUS AND METHOD FOR AUTOMATIC TRANSMISSION SYSTEM FLUID EXCHANGE AND INTERNAL SYSTEM FLUSHING, issued to Chen on Jan. 9, 1996, the disclosures of each of the above patent being hereby incorporated by reference, are examples.

For Example, Abbruzze diuscloses:

Referring to FIG. 1, an engine flushing apparatus 20 for flushing the internal lubrication system of an internal combustion engine 22 includes a conduit or hose 24 connecting the fluid output from the flushing apparatus to the engine by an oil filter port adapter assembly 26, and a second conduit or hose 28 returning flushing fluid to the flushing apparatus by means of an oil pan drain port adapter assembly 30 that is connected to the oil pan drain port of the engine. (Col. 3, lines 52–60)

In addition, notes Abruzze:

An oil pump 50 located within the oil pan interior chamber 37 is connected by a fluid passage 52 to an oil filter port 54. In normal engine operation a conventional oil filter, not illustrated, is connected at this port. Engine oil is pumped by a pump 50 from the oil pan interior chamber 37 via conduit 52 through the filter, exits the filter and flows via conduits 46, 42 and 44 into the engine, allowing the filter to remove particulate material and other impurities that may be contained in the oil before reaching crankshaft 40 and other engine components. (Col. 4, lines 30–39)

Grigorian V discloses:

The adapter assemblies for an engine flushing system includes an oil filter port adapter assembly and an oil drain plug port adapter assembly for connection between an engine flushing apparatus and the lubrication system of an internal combustion engine. (Abstract)

Grigorian V also discloses:

a novel adapter system for use in such apparatus, enabling the flushing apparatus to be connected to the oil drain pan and/or lubricating system of a large variety of internal combustion engines. (Col. 1, lines 12–15)

Also, according to Grigorian V:

Since the size and type of oil filter port and oil pan drain port differs from automobile manufacturer to manufacturer and even amongst different models or model year of a single auto manufacturer, the prior flushing apparatus includes a necessary set of associated adapters to permit connection of the conduits to the respective oil filter and drain plug ports of the vast majority of automobile engines.

. . .

It has been found that threaded connections between filter port adapters and an engine filter port can lock or seize up when the threaded connections of a filter port universal coupling member and filter port adapter work against each other during removal from an engine filter port, which can damage the threaded connections of the filter port adapters, and can make removal and disassembly of the flushing apparatus difficult and time consuming. (Col. 1, lines 60–Col. 2, line 24)

Further according to Grigorian V:

The present invention accordingly provides for a flushing apparatus for internally cleaning internal combustion engines. The flushing apparatus includes an adapter system with an oil filter port adapter assembly and an oil drain plug port adapter assembly. For a given engine a selected oil filter port adapter assembly couples the fluid conduit from the flushing apparatus to the oil filter port on the engine block. In one presently preferred embodiment, the invention provides for an improved engine flushing system for circulating flushing fluid through an internal combustion engine to clean the internal combustion engine, the engine being of the type containing an engine block, an oil filter port on the engine block and an oil drain pan having an oil drain plug port. The engine flushing system typically includes a flushing apparatus for delivering a volume of flushing fluid and receiving used flushing fluid, a first conduit for conducting flushing fluid from the flushing apparatus to the oil filter port, and second conduit for conducting flushing fluid from the oil drain plug port to the flushing apparatus. An oil filter port adapter assembly is provided for connecting the first conduit to the oil filter port, and the oil filter port adapter assembly preferably includes a plurality of adapter members. In a currently preferred aspect of the invention, the plurality of adapter members of the adapter assembly are mated together with a low tolerance sliding fit, and indexed by indexing pins with a low tolerance sliding fit into the adapter pieces, to provide for a secure connection between the plurality of adapter members without allowing the connection between the adapter members to seize up. (Col. 2, line 53–Col. 4, line 14)

Similar systems are disclosed in Grigorian IV, II, II and I. A similar system is disclosed in Flynn II and III. Flynn II discloses:

An engine oil system cleaning apparatus has a cleaning solution delivery line connected by an adapter to a running engine, and an exit line and a return line from the engine connected at an adapter at the engine oil pan. (Abstract)

In preparation for an engine cleaning operation, the engine oil filter is removed from its threaded opening and a filter adapter 12 is threadedly mounted in the engine oil filter opening; and an oil pan adapter 14 is threadedly mounted in the oil pan drain plug opening and has a passage therethrough for outward passage of cleaning fluid, as shown in lower portion of FIG. 1. A first oil filter adapter 12 has two passages therethrough, one connected with a solution delivery line for inflow of solution to the engine interior, and a second passage connected with the engine oil pan and with line 31 for outflow of cleaning solution helped by the engine oil pump. The oil filter adapter may be provided in a plurality of thread sizes to accommodate a variety of openings and thread sizes of various automobile manufacturers. (Col. 2, lines 23–36)

Flynn II discloses:

Preparatory to the cleaning operation, an engine oil filter of the engine to be cleaned is removed and an adapter 24 is threadedly mounted in the threaded oil filter opening.

Some engines utilize a canister-type adapter to be fitted into an oil filter housing. Referring to FIGS. 2 and 3, adapter 24 or 49 has two passages, one for inflow of cleaning solution to an engine interior, and the other for the outflow of the cleaning solution. Canister-type oil filter adapters are provided in a variety of openings and thread sizes. Adapters may be provided in a variety of thread sizes, and are typically color-coded to indicate respective openings and thread sizes of various automobile manufacturers.

In contrast with many prior art cleaning systems, wherein used or dirty engine oil is removed prior to cleaning operations, according to the invention, the used engine oil is preferably not drained prior to a cleaning operation.

The engine oil pump is utilized to pump oil and cleaning solution mixture throughout the engine, thus eliminating any need for a remote-mounted separate pump, as required in many prior systems. (Col 2, lines 3–22)

Similarly Edmiston discloses:

The inlet conduit is adapted for connection to the oil fill opening of the engine. An outlet conduit carries solution away from the engine. The outlet conduit is connected to the oil drain opening of the engine. A transport cart carries the pump, solution and waste solution tanks. (Abstract)

Further notes Edmiston:

As shown in FIG. 3, an inlet adapter 23 is connected to the oil fill opening of the engine. The inlet adapter is mounted on the second end of the inlet conduit. The inlet adapter comprises a cap 24 with an aperture 25 therethrough. The cap comprises a structure similar to a closure cap for closing the oil fill opening of the engine. A valve 26 is in fluid communication with the inlet conduit for selectively blocking flow of solution through the inlet conduit. The valve is located near the second end of the inlet conduit. (Col. 3, lines 33–43)

Robert discloses:

Apparatus and methods for flushing and cleaning the oil strainer and crankcase of an internal combustion engine of a type having a removable full-flow oil filter. The oil filter is temporarily replaced with a cartridge which has at least one passage therethrough which will communicate with the discharge side of the engine oil pump but does not communicate with the normal outflow port of the filter apparatus. A second passage therethrough may communicate with the outflow port of the filter system but does not communicate with the discharge of the oil pump. In a preferred method, the inlet of the first passage may be connected to a source of pressurized fluid to force the fluid, in a direction opposite to normal flow, through the passage, the oil pump and the oil strainer to agitate and flush contaminants in the oil strainer and crankcase. The pressurized fluid and contaminants are drained from the crankcase after which the cartridge is removed, a new oil filter installed and clean oil added to the engine. (Abstract)

Further notes Robert:

In FIG. 2, the oil filter system 4 and oil filter boss 10 is illustrated. However, the spin-on type oil filter 11 has been removed and replaced with a special reverse flush cartridge 20 which forms a portion of the present invention. The cartridge 20 is preferably cylindrical in shape and has the general appearance of a spin-on type oil filter. It would be provided with a central threaded hole 21 threadedly engageable with a threaded pipe portion 22 which normally depends downwardly from the filter boss 10 to which spin-on type oil filters are typically attached. The pipe 22 provides an outflow port 13 in communication with the oil distribution system of the moving parts of the engine E through the piping 14. An annular seal 23 around this threaded connection and an annular seal 24 around the upper periphery of the cartridge 20 seals the cartridge 20 to the filter boss 10 as it is threadedly connected to the pipe 22 by twisting or rotating the cylinder 20. Hand tightening should be sufficient to provide an adequate seal. An annular recessed area 25 surrounding the threaded pipe 22 is in fluid communication with inflow port 9 and piping 8 which is connected to the discharge of oil pump 3 (see FIG. 1).

The special reverse flush cartridge 20 has at least one passage 30 therethrough having an inlet 31 and an outlet 32 which communicates with inflow port 9 but does not communicate with outflow port 13. In the exemplary embodiment of FIG. 2, there is also another passage 35 therethrough which has an inlet 36 and an outlet 37 which may also communicate with the inflow port 9 and discharge piping 8 but does not communicate with outflow port 13. As shown in FIG. 2, the inlet 31 may be temporarily closed by a removable plug 38. Inlet 36 is shown with an air valve stem 39. (Col 4, line 58–Col. 5, line 22)

All of these systems of the prior art suffer from at least one common defect. The fact that they employ an adapter that is put in place of the oil filter for the automobile engine and/or the crank case drain, means that the flushing system needs to have and the operator of the flushing system needs to carry around a relatively large set of different adapters for different makes and models of cars, gasoline and diesel engines and the like. There exists, therefore a need for a flushing system that is simpler and easier to operate. In addtion there exists a need or a system that facilitates replacing the oil in the engine after the slushing has occurred, particularly if synthetic oil is to be used, which requires a complete flush before the introduction of the synthetic oil, which cannot be mixed with regular oil or the sludge and other carbonacious materials left behind inside of the engine after use with regular oil, which the flushing system serves to flush from inside of the engine. Furthermore, removal of tiny pieces of metal debris, e.g., from wear on the engine parts, which pieces are small enough to pass through the regular engine oil filter, but still capable of damaging or clogging engine parts is also desirable as a part of the flushing process according to an embodiment of the present invention.

SUMMARY OF THE INVENTION

A method and apparatus for connecting an engine flushing system for flushing the lubrication system of an engine having a detachable engine lubricant filter, with the detachable lubricant filter having an engine lubricant outlet portion and an engine lubricant inlet portion contained within a casing of the detachable engine lubricant filter is disclosed, which may comprise at least one flushing system connection unit adapted to connect the flushing system to at least one of the engine lubricant inlet portion and engine lubricant outlet portion of the detachable lubricant filter through the casing of the detachable engine lubricant filter. The at least on flushing connection unit may comprise a first flushing connection unit adapted to connect the flushing system to at least one of the engine lubricant inlet portion and engine lubricant outlet portion of the detachable lubricant filter, through the casing of the detachable engine lubricant filter; and a second flushing connection unit adapted to connect the flushing system to the lubrication system of the engine through an opening utilized for mechanically measuring the level of lubricant in the lubrication system of the engine. The connection unit may comprise a penetration member adapted to penetrate the casing of the detachable engine lubricant filter, and further comprises at least one flushing fluid opening adapted to place the flushing system in fluid communication with at least one of the engine lubricant inlet portion and the engine lubricant outlet portion of the detachable engine lubricant filter. The penetration member may comprises a screw at least a portion of the screw comprising a flushing fluid flow passage having at least one flushing fluid flow opening, or a connecting tube adapted to be inserted into a penetration port in the casing of the detachable engine lubricant filter. Another connection to the lubrication system may be through a tube inserted into a dip stick opening to the lubrication system of the engine. There may be two penetration members one in communication with an inlet of the filter and one with the outlet. There may be one single penetration member communicating with both the inlet and the outlet.

DETAILED DESCRIPTION OF THE PREFERRED EMBODIMENT

Figure 1:
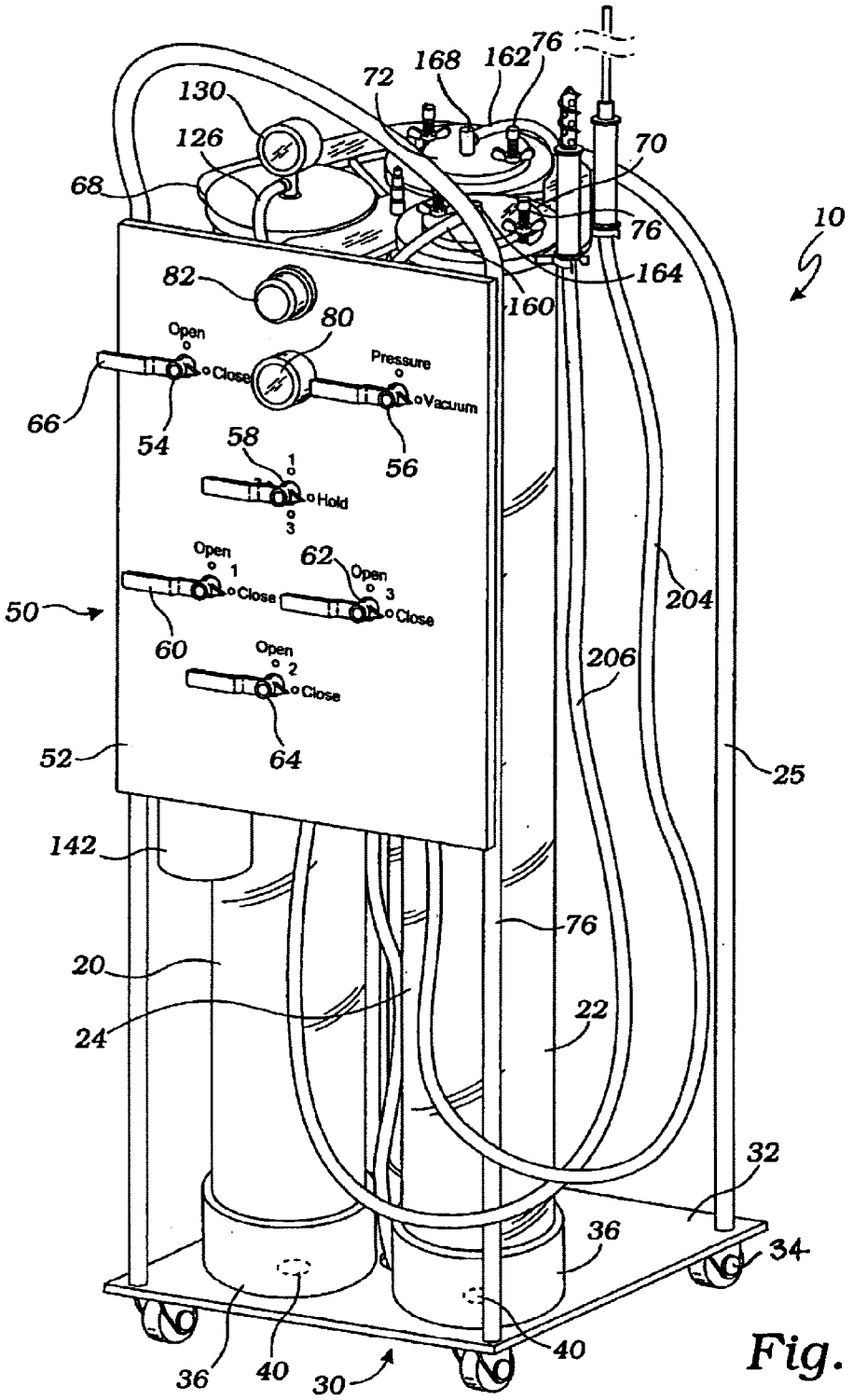
FIG. 1 shows a perspective view of a three tank flushing system according to an embodiment of the present invention.

Turning now to FIG. 1, there is shown a perspective view of a three tank engine lubrication system flushing system 10 according to an embodiment of the present invention. The engine lubrication system flushing system 10 may comprise, e.g., a flushing tank 1, 20, a flushing tank 2, 24, and a flushing tank 3, 22 each of which may be held on a stand floor 32 of a engine lubrication system flushing system 10 flushing system stand 30 by a respective one of the tank mounting rings 36, which may be attached to the stand floor 32 by any suitable means, e.g., by welding.

A flushing system control panel 50, having a control panel front plate 52 contains the controls for the engine lubrication system flushing system 10. Conveniently placed on the control panel front plate 52 are an air pressure control valve 54, a pressurization/suction control valve 56, a flushing system tank selection valve 58, a flushing system tank 1 control valve 60, a flushing system tank 3 control valve 62 and a flushing system tank 2 control valve 64, each of which may include a convenient operating handle 66. Also on the control panel front plate 52 of the flushing system control panel 50 are a pressure gauge 80 and a pressure regulator 82.

Figure 2:
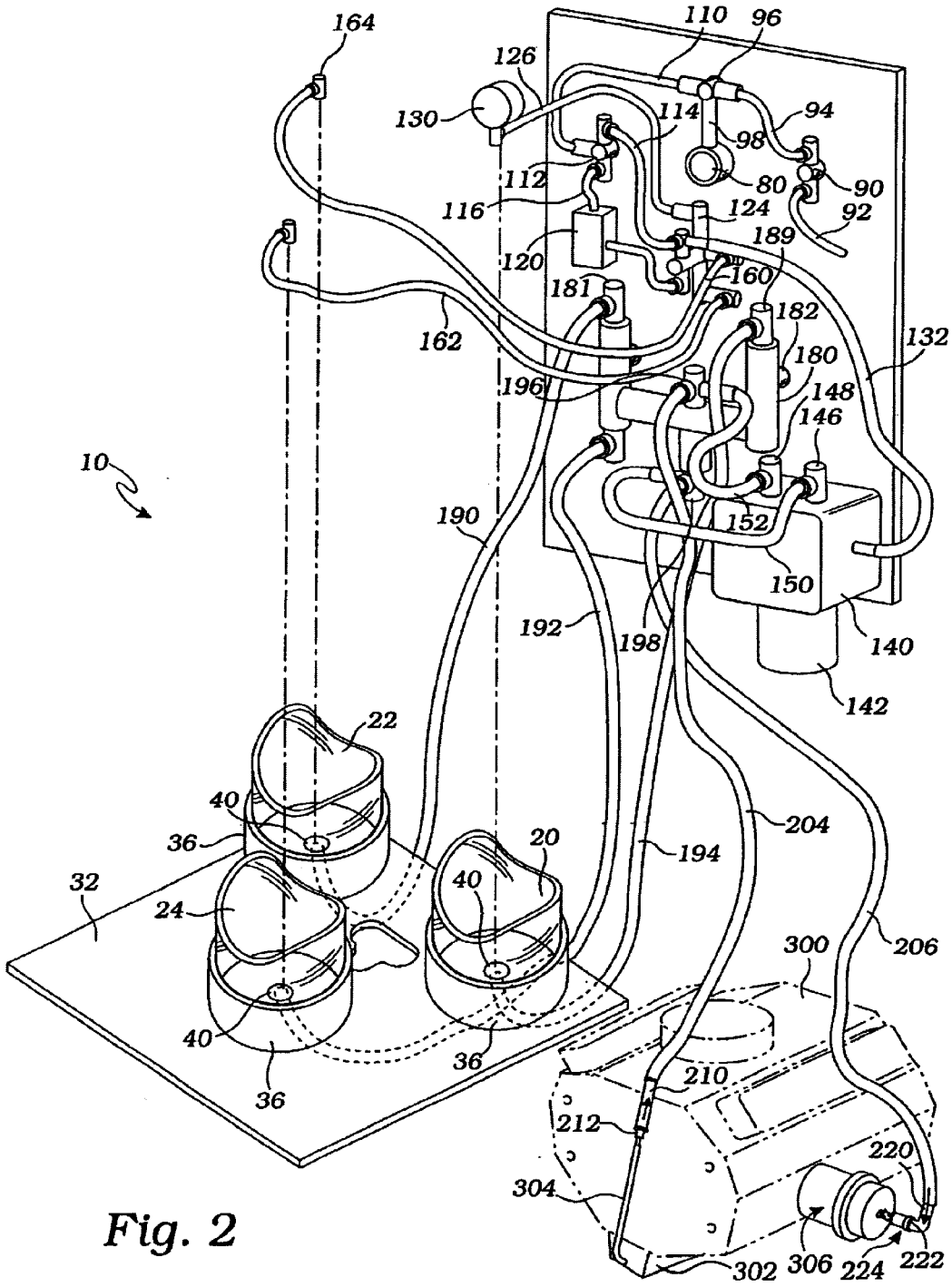
FIG. 2 shows the connections of the valves, connecting hoses and tanks according to the embodiment of the present invention as shown in FIG. 1.

Turning now to FIG. 2 there is shown the connections of the valves, connecting hoses and tanks according to the embodiment of the present invention as shown in FIG. 1. On the back side of the flushing system control panel 50 can be seen the portion 90 of the air pressure control valve 54 extending behind the control panel front plate 52 which is connected to an air pressure inlet hose 92 and to a air hose 94. When the air pressure control valve 54 is in the open position, as shown on the control panel front plate 52, the air pressure inlet hose 92 is connected to the air hose 94 through the air pressure control valve 54. Pressurized air supplied to air pressure inlet hose 92, e.g., from an automobile maintenance facility pressurized air system through, e.g., a suitable quick disconnect fitting (not shown) is connected through the air hose 94 to the pressure regulator 82 connection 96 and pressurized air at a selected pressure controlled by the pressure regulator 82 is supplied also to the pressure gauge 80 through a pressure gauge 80 connection 98.

Pressurized air is also supplied when the air pressure control valve 54 is in the open position to the pressurization/suction control valve 56 through an air hose 110. The pressurization/suction control valve 56 selected between the application of a pressure or a vacuum to a selected one of the flushing tank 1, 20, the flushing tank 3, 22, and the flushing tank 2, 24, by selecting between sending the pressurized air through air pressure connection hose 116 to the vacuum creation device 120, which may be, e.g., a venturi device, through vacuum connection hose 122 to the flushing system tank selection valve 58 or bypassing the vacuum creation device 120, and sending the pressurized air through the pressure connection hose 114 to the flushing system tank selection valve 58. The flushing system tank selection valve 58, therefore, has an input of either pressurized air through the air pressure connection hose 114 or a vacuum through the vacuum connection hose 122. The pressurized air or the vacuum may be directed to the respective one of the flushing tank 1, 20, flushing tank 3, 22, or the flushing tank 2, 24 selected by the flushing system tank selection valve 58, with the flushing system tank selection valve 58 also having a "hold" position, which simply maintains the status quo of the pressurization/suction applied to the various points in the engine lubrication system flushing system 10. Pressurized air or vacuum may be applied to the flushing tank 1, 20 through the flushing tank 1, 20 connection hose 126 when the flushing system tank selection valve 58 is in the "Tank 1" position. The flushing tank 1, 20 connection hose 126 also connects to the flushing tank 1, 20 at a fitting that includes a flushing tank 1, 20 pressure gauge 130.

Pressurized air or vacuum may be supplied to the flushing tank 3, 22 through the flushing system tank selection valve 58 connection to the flushing tank 3, 22 by the flushing tank 3, 22 air pressure/vacuum connection hose 160 and a flushing tank 3, 22 air pressure/vacuum connection 164 on the top of the flushing tank 3, 22. Pressurized air or a vacuum may be applied to the flushing tank 2, 24 through the flushing system tank selection valve 58 connection to the flushing tank 2, 24 air pressure/vacuum connection hose 162 and a flushing tank 2, 24 air pressure/vacuum connection 168 on the top of the flushing tank 2, 24.

A pneumatically operated pump 140 may be used also, in lieu of supplying pressurized air or vacuum to the various tanks, as explained in more detail in the applicants co-pending application, to provide flushing fluid for the operation of the engine lubrication system flushing system 10 according to an embodiment of the present invention. The pneumatically operated pump 140 may be, e.g., connected to high pressure air through an air pressure hose 132 when the air pressure control valve 54 is in the "Open" position and the pressurization/suction control valve 56 is in the "Pressure" position, as shown on the control panel front plate 52.

The pneumatically operated pump 140 has a pneumatically operated pump 140 outlet 146 and a pneumatically operated pump 140 inlet 148, and also has connected to it in the flow path through the pneumatically operated pump 140 a filter 142. The pneumatically operated pump 140 inlet 148 is connected to a flush control valve 200, an operator for which is not shown in FIG. 1 or in FIG. 2, but which could either be on the front panel 52 of on the vertically extending portion of the manifold 200 as shown in FIG. 2. This connection may be, through a pneumatically operated pump 140 inlet hose 152 and a flushing control manifold 180 connection 196 and is connected to the pneumatically operated pump 140 through an pneumatically operated pump 140 outlet hose 150 and a flushing control manifold 180 connection 198. Alternatively, to insure the proper flow in this embodiment, the vertically extending portion 200 may be fitted, e.g., with a pair of check valves, not shown, between the connections 196 and 198, to prevent flow from the connection 196 to the connection 198 except through the pimp 104 inlet 148 and outlet 146.

The flushing control manifold 180 connection 198 may be connected to a flush outlet hose 204 which may be connected to a flush outlet fitting 212 through a flush outlet hose connector 210 as explained in more detail below. The flushing control manifold 180 connection 198 may be connected to a flush input hose 206 which is also connected at its opposite end to a flush input connecting unit 224 through a flush input hose connector 220. The flush outlet fitting 212 may be adapted, e.g., to fit into the lubricant level checking mechanism 304 of a engine 300, e.g., an internal combustion engine 300. The engine 300 also contains a detachable lubricant filter 306, which is detachable and which is of a particular size and has a particular connection mechanism to the engine 300 depending upon the make and model of the engine/vehicle in which the engine 300 is, or other factors, e.g., whether the engine 300 is a gasoline or a diesel engine 300.

Figure 5:
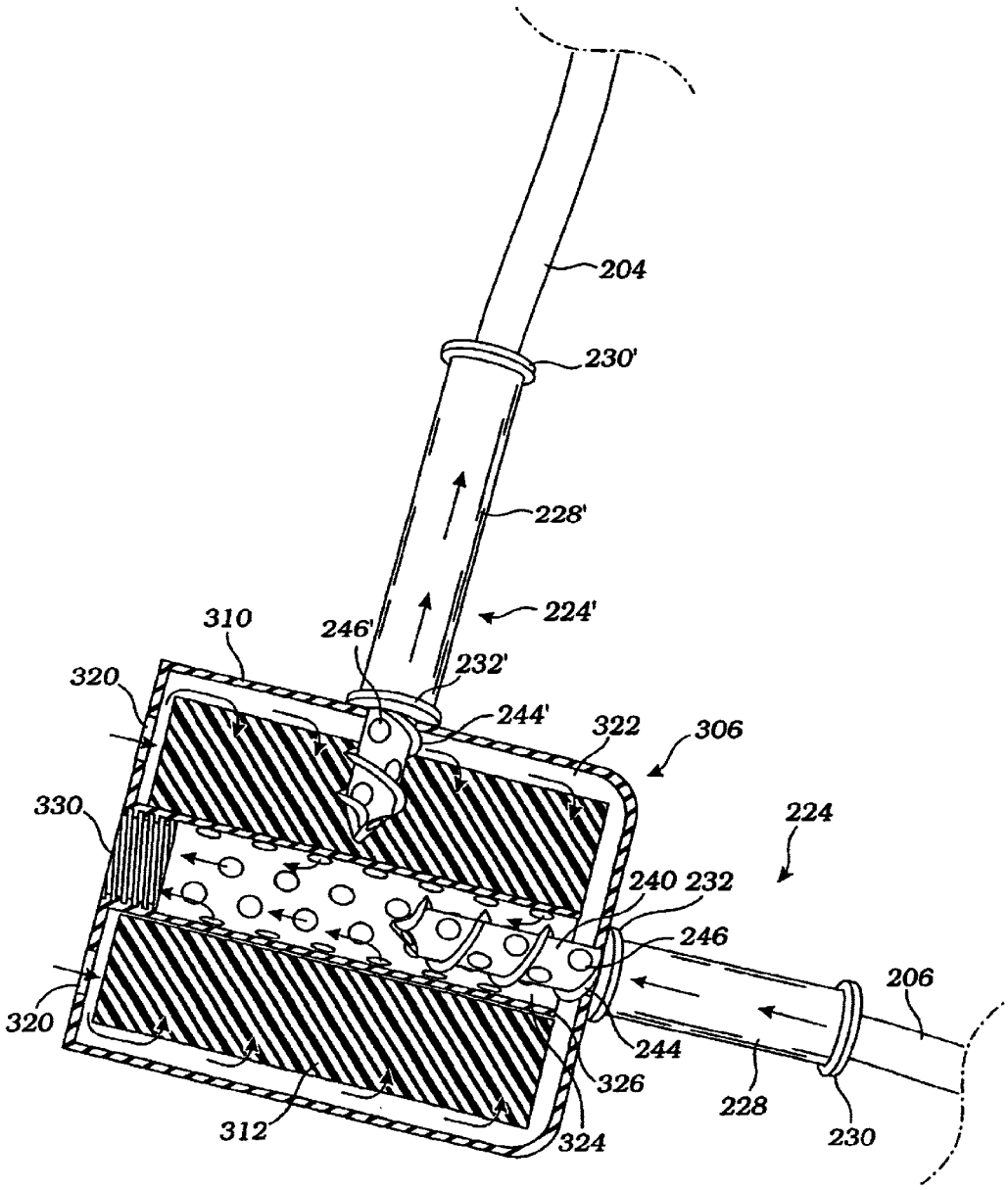
FIG. 5 shows an embodiment of a method and apparatus for connecting embodiments of the flushing system to an engine for flushing according to an embodiment of the present invention.

Turning now to FIG. 5, there is shown an embodiment of a method and apparatus for connecting embodiments of the flushing system to an engine 300 for flushing according to an embodiment of the present invention. As illustrated the detachable lubricant filter 306 may have, e.g., a casing 310 inside of which is contained a filter element 312, which may be in the shape generally of a cylinder surrounding a separating wall 326 defining within the separating wall 326 a lubricant filter outlet portion 324. The lubricant filter outlet portion 324 is in fluid communication with a lubricant filter engine supply outlet 330 and returns lubricant to the engine 300 through the lubricant filter engine supply outlet 330, while receiving lubricant through the filter element 312 by way of a plurality of fluid communication openings 340 in the separating wall 326.

When it is desired to perform engine flushing utilizing an embodiment of the engine lubrication system flushing system 10 of the present invention the flush input hose 206 may be connected to the lubricant filter outlet portion 324 by a flush input connecting unit 224 that is adapted to penetrate the casing 310 of the detachable lubricant filter 306 at an appropriate location. The flush input connecting unit 224 may further comprise a connector 228, which may have a flange 230, to connect the flush input connecting unit 224 to the flush input hose 206. It will be understood that the connector 228 could be any one of a variety of connectors well known in the art, e.g., any of a variety of quick disconnects and may also have, e.g., a built in check valve as part, e.g., of the connector 228 or the flange 230, to allow, e.g., the disconnection of the flush input hose 206 from the connector 228 when the inside of the casing 310 of the detachable lubricant filter 306 is under pressure, e.g., during operation of the engine 300 as flushing process is ongoing or about to commence according the various possible embodiments of the present invention.

The flush input connecting unit 224 may have a penetrating mechanism 240 which may be comprised, e.g., in one possible embodiment of the present invention, of a hollow screw member penetrating mechanism 240, which may comprise a pointed end 242 for more conveniently penetrating the casing 310 of the detachable lubricant filter 306, and a plurality of fluid communication openings 246. The penetrating mechanism 240 may also comprise a screw thread 244 for further facilitate the penetration of the flush input connecting unit 224 into the appropriate portion of the detachable lubricant filter 306 and to seal the opening formed by such penetration. This may be further facilitated by a sealing flange 232, which may be a part of the connector 228 or the penetrating mechanism 240 and my be formed, e.g., of a natural or synthetic rubber compound, e.g., neoprene, or may be associated with a separate sealing ring (not shown) positioned between the flange 232 and the outer surface of the casing 310 for sealing once the penetrating mechanism 240 is inserted into the detachable lubricant filter 306.

As shown in the possible embodiment of FIG. 5, the flush input connecting unit 224 is inserted into the lubrication filter outlet portion 324 sufficiently for at least some of the plurality of penetrating mechanism 240 are inside of the lubricant filter outlet portion 324. Also shown is a connection of a modified flush input connecting unit 224' including, e.g., a connector 228,' a flange 230', a sealing flange 232', a penetrating mechanism 240', and a plurality of fluid communication openings 246'. The flush input connecting unit 224' is shown to be of a shorter length than the flush input connecting unit 224 and is adapted to penetrate the sidewalls of the casing 310 of the detachable lubricant filter 306, and only penetrated into the lubricant filter inlet portion 322 of the detachable lubricant filter 306. To insure proper circulatory flow, e.g., there may be placed a single check valve (not shown) between the connections 196 and 198, which can, e.g., allow flow between the connection 196 and the horizontal portion of the manifold 108' while not allowing flow from the connection 198 to the connection 196.

Figure 6:
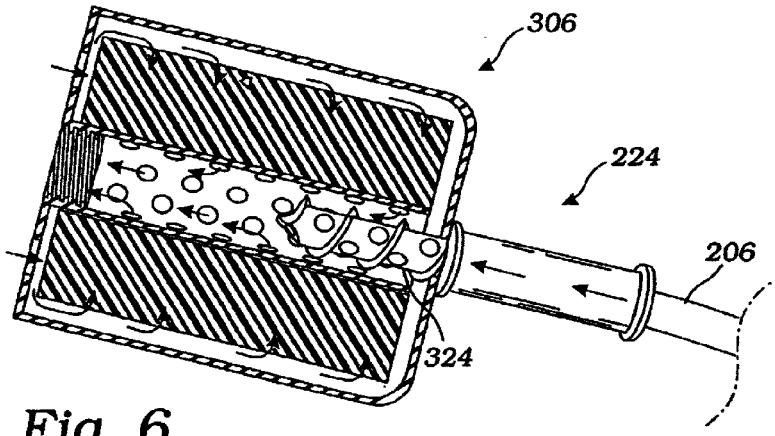
FIG. 6 shows another embodiment of a method and apparatus for connecting embodiments of the flushing system to an engine for flushing according to an embodiment of the present invention.

Turning now to FIG. 6 there is shown another embodiment of a method and apparatus for connecting embodiments of the engine lubrication system flushing system 10 to an engine 300 for flushing according to an embodiment of the present invention. In the embodiment illustrated in FIG. 6, there is only a flush input connecting unit 224 inserted into the lubricant filter outlet portion 324.

Figure 7:
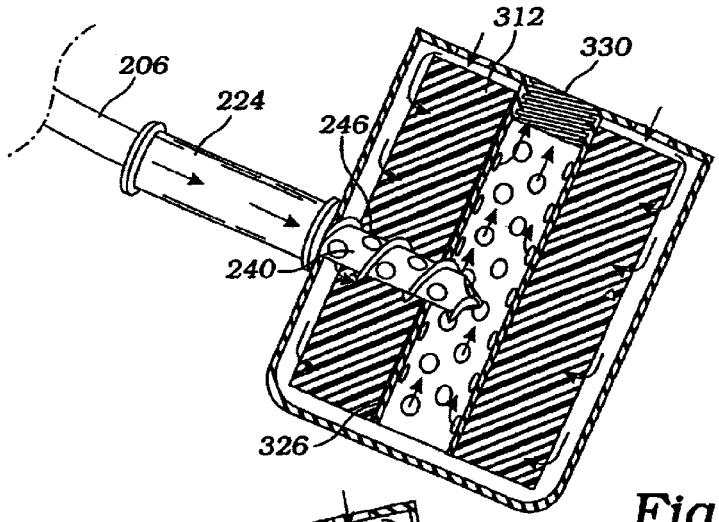
FIG. 7 shows still another embodiment of a method and apparatus for connecting embodiments of the flushing system to an engine for flushing according to an embodiment of the present invention.

Turning now to FIG. 7, there is shown still another embodiment of a method and apparatus for connecting embodiments of the engine lubrication system flushing system 10 to an engine 300 for flushing according to an embodiment of the present invention. In the embodiment shown in FIG. 7, the penetrating mechanism 240 on the flush input connecting unit 224 penetrates the sidewall of the casing 310 of the detachable lubricant filter 306 and passes through the filter element 312 and penetrates the separating wall 326, also entering into the lubricant filter outlet portion 324. In this embodiment of FIG. 7, the fluid communication openings 246 on the penetrating mechanism 240 are in fluid communication with both the filter element 312 portion of the detachable lubricant filter 306 and the lubricant filter engine supply outlet 330.

Figure 8:
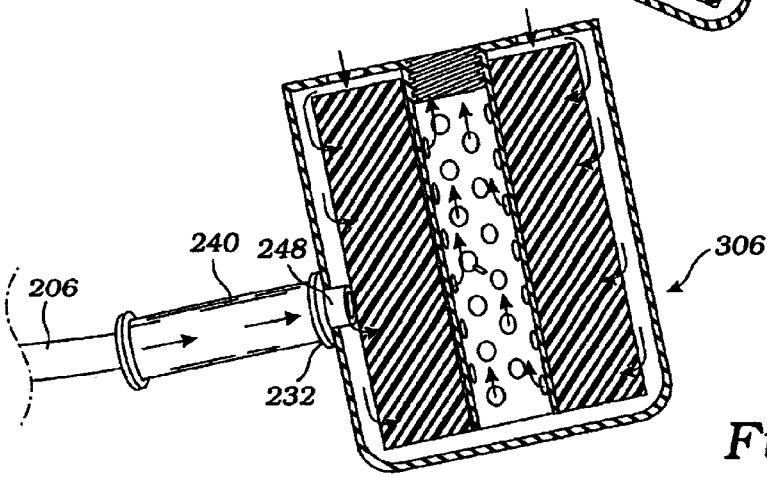
FIG. 8 shows a further embodiment of a method and apparatus for connecting embodiments of the flushing system to an engine for flushing according to an embodiment of the present invention.

Turning now to FIG. 8, there is shown a further embodiment of a method and apparatus for connecting embodiments of the engine lubrication system flushing system 10 to an engine 300 for flushing according to an embodiment of the present invention. In the embodiment of FIG. 8, the penetrating mechanism 240 has a hollow penetrating member 248, which does not have either the screw thread 244 or the pointed end pointed end 242, as are shown in FIGS. 5–7. The embodiment of FIG. 8 is intended to penetrate the casing 310 of the detachable lubricant filter 306, e.g., through a pre-constructed access opening. The pre-constructed access opening may be, e.g., a scored area on the casing 310 of the detachable lubricant filter 306, which, when the hollow penetrating member 248 is brought into contact with it gives way, e.g., in the manner of a soda can pop-top, and allows the hollow penetrating member 248 top pass through the opening created in the casing 310 of the detachable lubricant filter 306.

Figure 3:
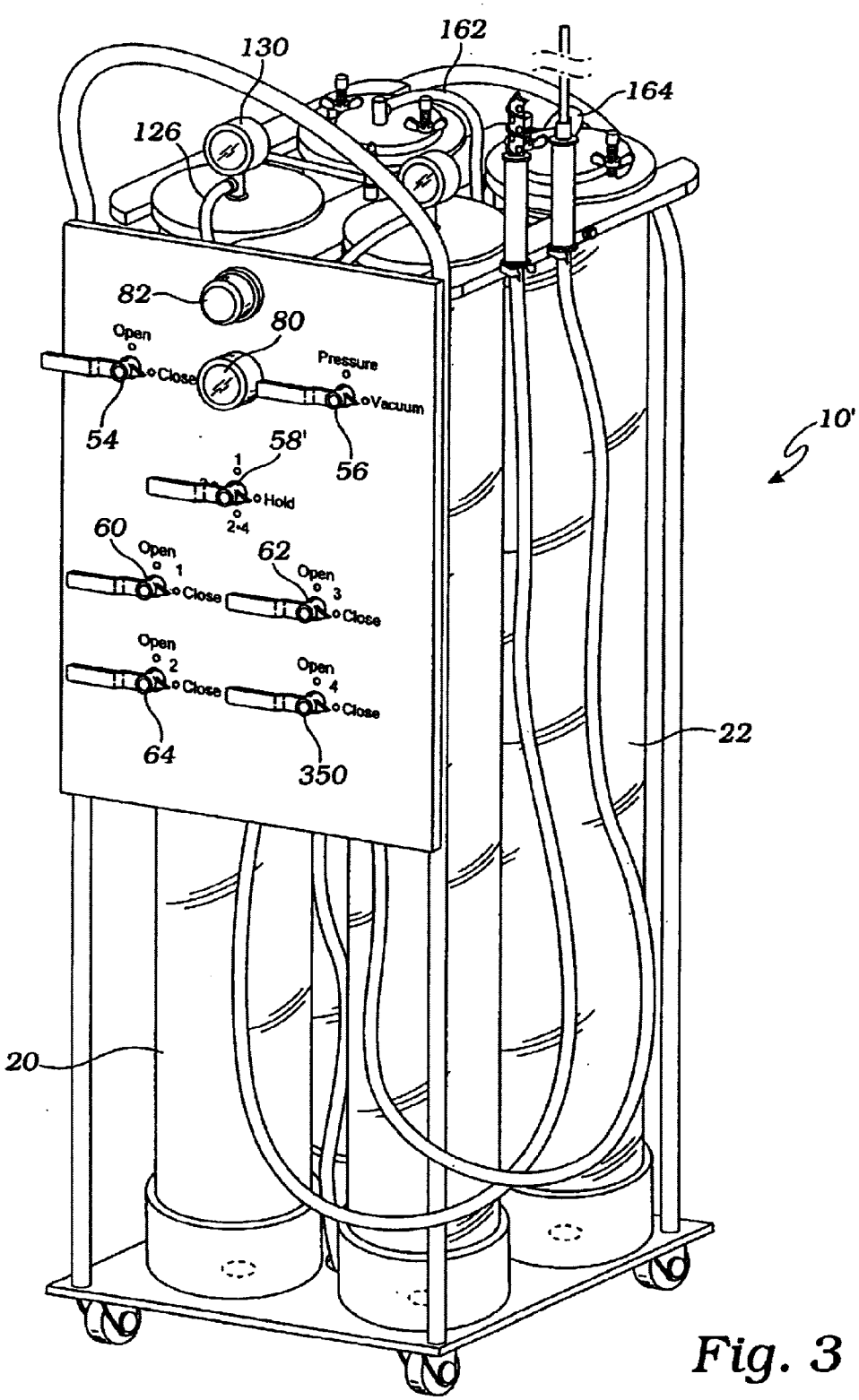
FIG. 3 shows a perspective view of a four tank flushing system according to another embodiment of the present invention.
Figure 4:
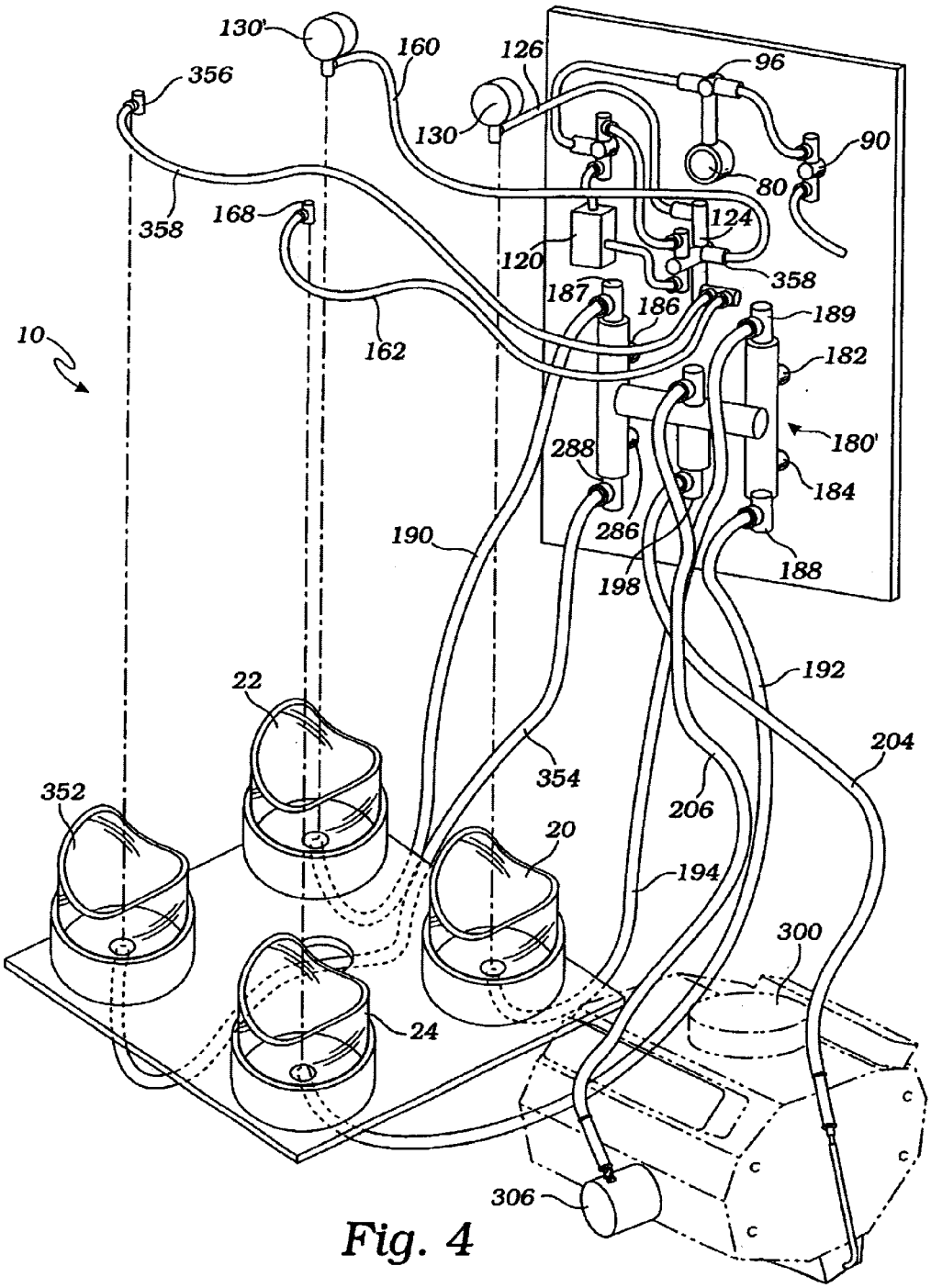
FIG. 4 shows the connections of the valves, connecting hoses and tanks according to the embodiment of the present invention as shown in FIG. 3.

Turning now to FIGS. 3 and 4, there is shown a perspective view of a four tank engine lubrication system flushing system 10' according to another embodiment of the present invention and the connections of the valves, connecting hoses and tanks according to the embodiment of the present invention.

To the system of FIGS. 1 and 2 has been added a flushing tank 4, 352 which is connected to the flushing control manifold 180 through a flushing tank connection 288. The flushing tank connection 288 is connected to the flushing control manifold 180 connection 198 and the flushing control manifold 180 connection 196 when the tank 4 control valve 350 operated through the the portion of the tank 4 control valve 350 extending behind the control panel front plate 52, 286 is in the "open" position as shown on the flushing system control panel 50 illustrated in FIG. 3.

The tank 4 352 is connected to the portion 124 of the flushing system tank selection valve 58 extending behind the control panel front plate 52 through a flushing tank 4 top pressurization connection 356 and a flushing tank 4 pressure/vacuum hose 358. As shown in FIG. 3, the flushing tank 3, 22 air pressure/vacuum connection 164 may have attached to it a flushing tank 3, 20 pressure gauge flushing tank 1, 20 pressure gauge 130'.

In operation the embodiment shown in FIG. 3 and FIG. 4 may operate, e.g., by connecting the flushing tank 1, 20 to a vacuum through the portion 124 of the flushing system tank selection valve 58 extending behind the control panel front plate 52 and the vacuum output of the vacuum creation device 120 when the pressurization/suction control valve 56 is in the vacuum position and the flushing system tank selection valve 58 is in the "1" position and the drain connection openings 40 may be connected to the flush outlet hose 204 through the flush control valve 200 to draw used and dirty lubricant from the engine 300 through, e.g., the flush outlet hose connector 210 and its flush outlet fitting 212 tube inserted into the lubricant level checking mechanism 304. Thereafter, the pressurization/suction control valve 56 may be placed in the "Pressure" position and the flushing tank 3, 22 connected through the flushing tank 3, 22 air pressure/vacuum connection 164 to the portion 124 of the flushing system tank selection valve 58 extending behind the control panel front plate 52 while the flushing tank 3, 22 is connected to the flush input hose 206 through the flushing tank 2, 24 fluid connection hose 190 and the flush control valve 200 to force cleansing fluid into the engine 300 through the flush input connecting unit 224 connected through the casing 310 of the 306, such that the interior of the engine 300 is filled with the cleansing fluid. Thereafter, either a pneumatically operated pump 140 as shown in FIG. 4, with or without the engine running, or the oil pump inside of the engine 300 with the engine running, or the alternating connection of pressure to the flush input hose 206 and suction to the flush outlet hose 204 will serve to circulate the cleansing fluid through the engine 300. This may be done, as will be understood by those in the art with a closed loop through one or both of the flushing tank 1, 20 and flushing tank 3, 22, or only one of the flushing tank I, 20 and flushing tank 3, 22, e.g., using the pneumatically operated pump 140 or the oil pump inside the engine, or by alternating pressurization and suction applied to one or both of the flush outlet hose 204 and flush input hose 206, in various configurations of the engine lubrication system flushing system 10 according to embodiments of the invention. In the end, after suitable circulation of the cleansing fluid through the interior of the lubricating system of the engine 300, the spent cleansing fluid can be removed as will be understood by a variety of combinations of pressure/suction connections, or with the pneumatically operated pump 140, etc.

Finally, fresh lubricant, which may be, e.g., synthetic lubricant and may be stored, e.g., in the tank 4 352, and which generally is undesirable to mix with regular oil, or cleansing fluid containing regular oil, or put into a tank previously having contained regular oil or spent cleansing fluid containing some regular oil, without the flushing of such tank, may then be put under pressure, or pumped through the pneumatically operated pump 140 or suctioned using the internal oil pump and replace the old and dirty lubricant.

Figure 9:
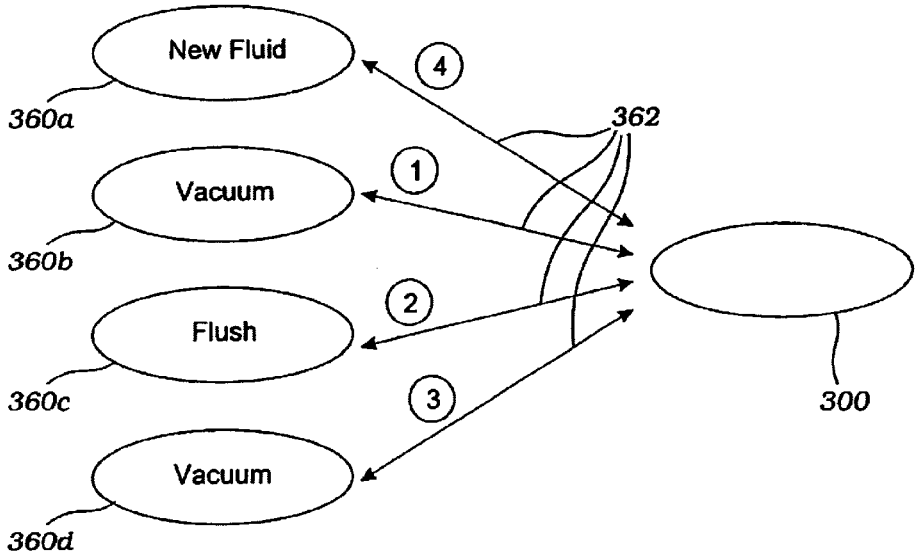
FIG. 9 shows a schematic representation of an operation of a four tank embodiment according to one aspect of the present invention.

Turning to FIG. 9, there is illustrated schematically the operation of an embodiment of the present invention wherein the, e.g., four tanks 360*a–d* are connected, e.g., to an engine 300 such that flush fluid from a tank. e.g., tank 360*c* may be sent to tho engine 300 through an input output-line 362 due to pressure being placed in the tank 360*c* and may be withdrawn from the engine 300, e.g., into the tank 360*d* due to a vacuum-being applied to the tank 360*c*, or the pressure and vacuum in the respective tanks 360*c* and *d* may be simultaneously applied. Similarly, the old fluid, e.g., lubricant may be removed from the engine 300 by placing a vacuum on tank 360*b* either before or in conjunction with pressure being applied to the tank 360*a* with the fresh fluid, e.g., lubricant, in iL.

The foregoing invention has been described in relation to a presently preferred embodiment thereof. The invention should not be considered limited to this embodiment. Those skilled in the art will appreciate that many variations and modifications to the presently preferred embodiment, many of which are specifically referenced above, may be made without departing from the spirit and scope of the appended claims. The inventions should be measured in scope from the appended claims.

We claim:

1. An apparatus adapted to connect an engine flushing system with an engine, the engine having a detachable lubricant filter including an outlet portion and an inlet portion contained within a casing of the detachable engine lubricant filter, the apparatus comprising: at least one flushing system connection unit adapted to connect the flushing system to at least one of the engine lubricant inlet portion and engine lubricant outlet portion of the detachable lubricant filter through the casing of the detachable engine lubricant filter; wherein, the at least one flushing connection unit comprises a penetration member adapted to penetrate the casing of the detachable engine lubricant filter, and further comprises at least one flushing fluid opening adapted to place the flushing system in fluid communication with at least one of the engine lubricant inlet portion and the engine lubricant outlet portion of the detachable engine lubricant filter.

2. The apparatus of claim 1 further comprising: a first flushing connection unit adapted to connect the flushing system to at least one of the engine lubricant inlet portion and engine lubricant outlet portion of the detachable lubricant filter, through the casing of the detachable engine lubricant filter; and a second flushing connection unit adapted to connect the flushing system to the lubrication system of the engine through an opening utilized for mechanically measuring the level of lubricant in the lubrication system of the engine.

3. The apparatus of claim 1 further comprising: a screw; at least a portion of the screw comprising a flushing fluid flow passage having at least one flushing fluid flow opening.

4. The apparatus of claim 2 further comprising: a screw; at least a portion of the screw comprising a flushing fluid flow passage having at least one flushing fluid flow opening; the second flushing system connection unit comprises an elongated tube of a size capable of being inserted into a dip stick opening of the lubrication system of the engine.

5. The apparatus of claim 1 further comprising: a first penetration member adapted to penetrate the casing of the detachable engine lubricant filter to connect the flushing system to the engine lubricant inlet portion of the detachable lubricant filter, through the casing of the detachable engine lubricant filter; and a second penetration member adapted to penetrate the casing of the detachable engine lubricant filter to connect the flushing system to the engine lubricant outlet portion of the detachable lubricant filter, through the casing of the detachable engine lubricant filter.

6. The apparatus of claim 5 further comprising: each of the first and second penetration members further comprises a screw; at least a portion of the screw comprising a flushing fluid flow passage having at least one flushing fluid flow opening.

7. The apparatus of claim 1 further comprising: a connecting tube adapted to be inserted into a penetration port in the casing of the detachable engine lubricant filter.

8. The apparatus of claim 2 further comprising: a connecting tube adapted to be inserted into a penetration port in the casing of the detachable engine lubricant filter.

9. The apparatus of claim 4 further comprising: a connecting tube adapted to be inserted into a penetration port in the casing of the detachable engine lubricant filter.

10. The apparatus of claim 5 futher comprising: a connecting tube adapted to be inserted into a penetration port in the casing of the detachable engine lubricant filter.

11. The apparatus of claim 1 further comprising: a single flushing system connection unit adapted to connect the flushing system to both of the engine lubricant inlet portion and engine lubricant outlet portion of the detachable lubricant filter, through the casing of the detachable engine lubricant filter.

12. The apparatus of claim 11, further comprising: a penetration member adapted to penetrate the casing of the detachable engine lubricant filter.

13. The apparatus of claim 12 further comprising: a screw; at least a portion of the screw comprising a flushing fluid flow passage having a plurality of flushing fluid flow openings.

14. An apparatus adapted to connect an engine flushing system for flushing the lubrication system of an engine having a detachable engine lubricant filter, with the detachable lubricant filter, the filter having an engine lubricant outlet portion and an engine lubricant inlet portion contained within a casing, comprising: at least one flushing system connection means for connecting the flushing system to at least one of the engine lubricant inlet portion and engine lubricant outlet portion of the detachable lubricant filter through the casing of the detachable engine lubricant filter, wherein, the at least one flushing connection means further comprises a penetration means for penetrating the casing of the detachable engine lubricant filter, and further comprises at least one flushing fluid opening placing the flushing system in fluid communication with at least one of the engine lubricant inlet portion and the engine lubricant outlet portion of the detachable engine lubricant filter.

15. The apparatus of claim 14 further comprising: a first flushing connection means for connecting the flushing system to at least one of the engine lubricant inlet portion and engine lubricant outlet portion of the detachable lubricant filter, through the casing of the detachable engine lubricant filter; and a second flushing connection means for connecting the flushing system to the lubrication system of the engine through an opening utilized for mechanically measuring the level of lubricant in the lubrication system of the engine.

16. The apparatus of claim 14 further comprising: a screw; at least a portion of the screw comprising a flushing fluid flow passage having at least one flushing fluid flow opening.

17. The apparatus of claim 15 further comprising: a screw; at least a portion of the screw comprising a flushing fluid flow passage having at least one flushing fluid flow opening; the second flushing system connection unit comprises an elongated tube of a size capable of being inserted into a dip stick opening to the lubrication system of the engine.

18. The apparatus of claim 14 further comprising: a first penetration means for penetrating the casing of the detachable engine lubricant filter to connect the flushing system to the engine lubricant inlet portion of the detachable lubricant filter, through the casing of the detachable engine lubricant filter; and a second penetration means for penetrating the casing of the detachable engine lubricant filter to connect the flushing system to the engine lubricant outlet portion of the detachable lubricant filter, through the casing of the detachable engine lubricant filter.

19. The apparatus of claim 18 further comprising: a screw; at least a portion of the screw comprising a flushing fluid flow passage having at least one flushing fluid flow opening.

20. The apparatus of claim 14 further comprising: a connecting tube means for insertion into a penetration port in the casing of the detachable engine lubricant filter.

21. The apparatus of claim 15 further comprising: a connecting tube means for insertion into a penetration port in the casing of the detachable engine lubricant filter.

22. The apparatus of claim 17 further comprising: a connecting tube means for insertion into a penetration port in the casing of the detachable engine lubricant filter.

23. The apparatus of claim 18 further comprising: a connecting tube means for insertion into a penetration port in the easing of the detachable engine lubricant filter.

24. The apparatus of claim 14 further comprising: a single flushing system connection means for connecting the flushing system to both of the engine lubricant inlet portion and engine lubricant outlet portion of the detachable lubricant filter, through the casing of the detachable engine lubricant filter.

25. The apparatus of claim 24, further comprising: a penetration means for penetrating the casing of the detachable engine lubricant filter.

26. The apparatus of claim 25 further comprising: a screw; at least a portion of the screw comprising a flushing fluid flow passage having a plurality of flushing fluid flow openings.

* * * * *